United States Patent [19]

Broberg, Jr.

[11] 4,423,757

[45] Jan. 3, 1984

[54] DEVICE FOR FORMING CLOSABLE WIRE SPRING SNAPS

[75] Inventor: Dewey O. Broberg, Jr., Long Grove, Ill.

[73] Assignee: Du-Bro Products, Inc., Wauconda, Ill.

[21] Appl. No.: 371,678

[22] Filed: Apr. 26, 1982

[51] Int. Cl.[3] ..... B21F 0/00

[52] U.S. Cl. ..... 140/123; 140/104; 140/106

[58] Field of Search ..... 140/104, 102.5, 123, 140/124, 106

[56] References Cited

U.S. PATENT DOCUMENTS

| | | | |
|---|---|---|---|
| 2,006,355 | 7/1935 | Howell | 140/104 |
| 3,253,286 | 5/1966 | Bacon | 140/102.5 |
| 3,921,275 | 11/1975 | Hartl | 140/124 |

*Primary Examiner*—Francis S. Husar
*Assistant Examiner*—Linda McLaughlin
*Attorney, Agent, or Firm*—Hosier, Niro & Daleiden

[57] ABSTRACT

A device is disclosed for forming closable spring snaps from wire. The device is in the form of a hand tool and includes an elongated solid body having a plurality of pins fixed to and protruding outwardly from the body, in conjunction with a bore through the body and a groove cut into the side of the body. The pins, bore and groove are used in various combinations to form an eyelet at one end of a length of wire, to form an open latch loop at an opposite end of the length of wire, and to bend the length of wire intermediate the ends thereof with the wire bent back toward itself whereby the open latch loop is engageable with the one end of the wire inwardly of the eyelet to form a closable spring snap.

22 Claims, 13 Drawing Figures

DEVICE FOR FORMING CLOSABLE WIRE SPRING SNAPS

BACKGROUND AND SUMMARY OF THE INVENTION

This invention relates generally to wire forming and twisting devices, and more particularly to a device for forming closable spring snaps from wire. The invention is of particular interest to fishermen who wish to make their own wire snaps for connecting fishing lures, hooks, or the like to fishing line.

A fisherman often uses a wire extension at the end of a fishing line so that a fish, upon being caught, will be unable to break or cut the line and escape. The wire extension is called a leader. Attached to the leader may be a lure for attracting fish. Hooks also may be attached to the leader directly. There are commercially available an assortment of leaders and lures, but the preparation of leaders and lures is a highly individual matter for those to whom fishing is an art. Consequently, individuals often prefer to fabricate their own leaders and lures. A wide variety of devices are known for such purposes.

On the other hand, closable wire spring snaps also are employed often on the ends of leaders or directly attached to the end of a fishing line. Such closable snaps are used to permit rapid interchangement of lures, hooks, or the like in order to vary or experiment with lures in attracting fish, or a line simply will break resulting in loss of the closable snap, lure, etc. therewith. Such snaps are relatively expensive and often are manufactured in conjunction with swivels already attached to the snaps. Little effort heretofore has been made to provide a device or hand tool with which a fisherman can fabricate snaps simply and rapidly, just as with the fabrication of leaders.

An object, therefore, of the present invention is to provide a new and improved wire forming and twisting device and particularly to a device for forming closable spring snaps from wire.

In the exemplary embodiment of the invention, the closable snap forming device is in the form of an easily manipulatable hand tool including a solid body with no moving parts. Means is provided on the body for forming an eyelet at one end of a length of wire and for forming an open latch loop at an opposite end of the length of wire. Means is provided on the body for bending the length of wire intermediate the ends thereof with the wire bent back toward itself whereby the open latch loop is engageable with the one end of the wire inwardly of the eyelet to form a closable spring snap.

As disclosed herein, the body is elongated and the means for forming the eyelet includes a pair of spaced pins fixed to and protruding outwardly from one end of the body. These pins are used for forming a closed loop at the one end of the length of wire with a free end portion of the wire extending away from the closed loop. One pin provides an abutment stop for the wire, and the other pin provides a rounded surface about which the wire is bent to form the closed loop. A bore extends transversely through the body intermediate the ends thereof for receiving and positioning the length of wire after the closed loop is formed. A third, headed pin protrudes outwardly from the side of the body adjacent to but spaced from the end of the bore for engaging the free end portion of the wire and twisting the free end portion about the length of wire in response to rotation of the closed loop.

The pair of pins on the end of the elongated body then are used to form the open latch loop at the opposite end of the length of wire.

After the open latch loop is formed on the opposite end of the length of wire, the open loop is positioned within a transverse groove cut into one side of the elongated body. The groove is slightly wider than the thickness of the wire and provides means for holding the open loop. The length of wire then is bent longitudinally of the body so that the open latch loop extends at a right angle to the length of wire.

With the open latch loop having been formed in the length of wire at the end thereof opposite the eyelet, the open latch loop is again inserted into the transverse groove and held therein while the length of wire is wrapped about a fourth pin fixed to and protruding outwardly from the side of the body. The wire is bent back toward itself until the open latch loop is engageable with the opposite end of the wire inwardly of the eyelet to form a closable spring snap.

The simple hand tool of the present invention is remarkably efficient in rapidly forming a complete closable spring snap from a supply of wire and yet the tool has no moving parts. Individual fabrication of such closable spring snaps not only can save a fisherman the expense of commercially manufactured snaps, but such snaps can save a fisherman considerable on-site time should a supply of snaps have become depleted.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figures 1, 2, 3, 4, 5, 6, 7, 8, 9, 10, 11, 12, 13:
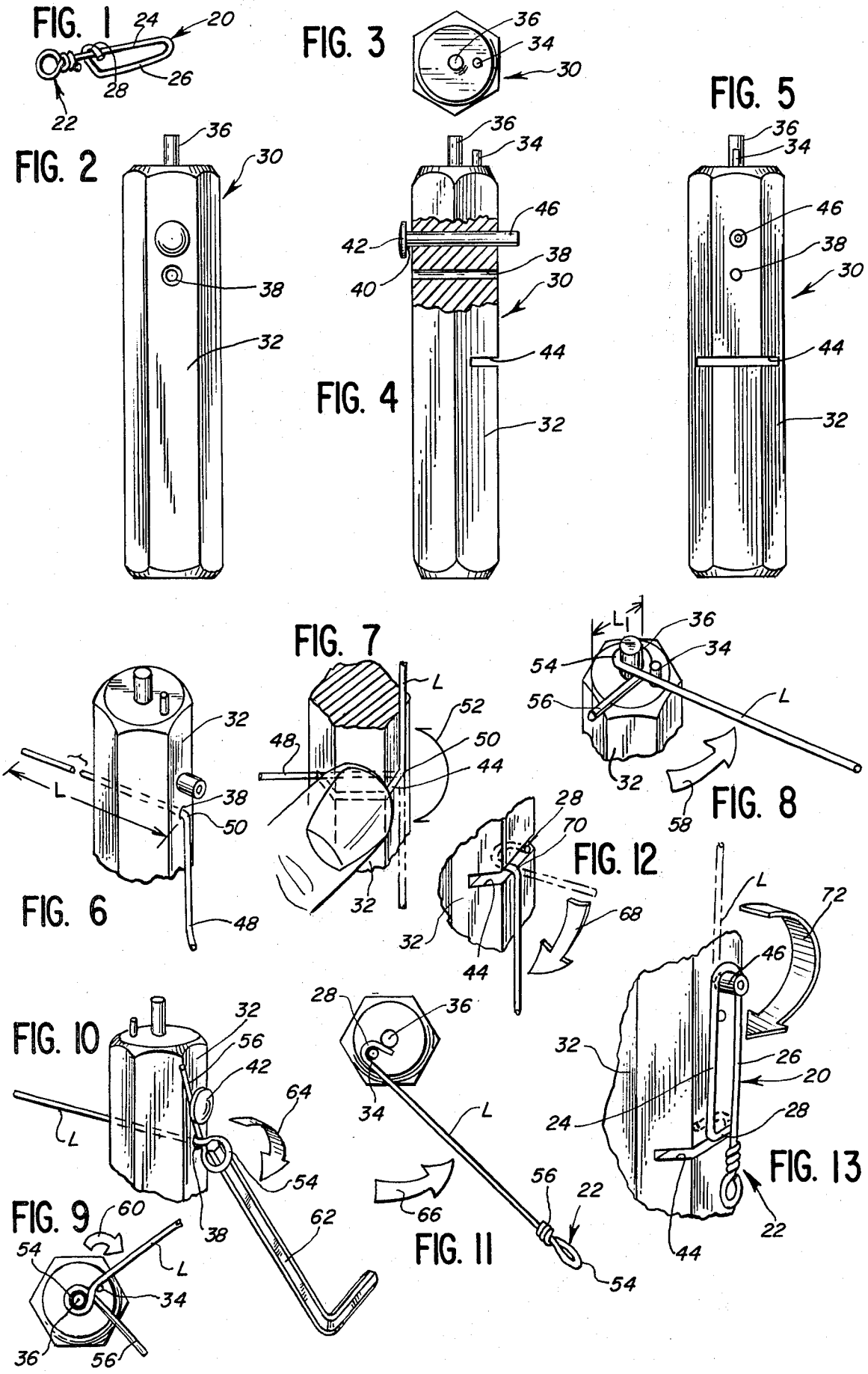
FIG. 1 is a perspective view of a closable spring snap formed from wire by the tool of the present invention.
FIG. 2 is a side elevational view of the tool of the present invention.
FIG. 3 is a top plan view of the tool.
FIG. 4 is a side elevational view of the tool, rotated 90° from FIG. 2, and partially cut away to facilitate the illustration.
FIG. 5 is a side elevational view of the side of the tool opposite that shown in FIG. 2.
FIG. 6 is a fragmentary perspective view of the top end of the tool, with a length of wire being bent from a supply thereof.
FIG. 7 is a fragmentary perspective view of an intermediate portion of the tool, with the length of wire inserted into a side slot for bending the length until severed from the supply of wire.
FIG. 8 is a fragmentary perspective view of the top of the tool, with the length of wire being bent to initially form a closed loop at one end thereof.
FIG. 9 is a top plan view of the tool, with the length of wire being bent to completely form the closed loop.
FIG. 10 is a fragmentary perspective view of the top end of the tool, with the length of wire inserted through a bore therein and about to be twisted to completely form an eyelet at one end of the wire.
FIG. 11 is a top plan view of the tool, with the wire positioned to form an open latch loop at the opposite end of the length of wire.
FIG. 12 is a fragmentary perspective view of an intermediate portion of the tool, with the open latch loop positioned in the side groove of the tool and being bent to form the open latch loop generally perpendicular to the length of wire.
FIG. 13 is a fragmentary perspective view of an intermediate portion of the tool, with the wire being bent back upon itself to form a completed closable spring snap.

Referring to the drawings in greater detail, and first to FIG. 1, a closable spring snap, generally designated 20, is shown as having been formed by the tool of the present invention. The snap includes an eyelet, generally designated 22, a length of wire 24 extending away from the eyelet, a second length of wire 26 bent back over the first length toward eyelet 22 and terminating in an open latch loop 28 which snaps behind wire length 24. The wire itself is fabricated from a relatively stiff spring wire to provide resiliency for the snap to permit repeated opening and closing thereof to releasably secure fishing lures, hooks, or the like, to the end of a fishing line or leader. Eyelet 22 is used for securing to the end of a fishing line or leader. A swivel (not shown) also may be secured to eyelet 22 as described hereinafter, to dispose the swivel between the snap and the fishing line or leader.

The device of the present invention is in the form of an easily manipulatable hand tool and is generally designated 30 in FIGS. 3–5. The device or tool includes an elongated solid body 32 which is fabricated of durable material, such as brass, to withstand wear which might be caused by repeated engagement and working with the spring wire of which snap 20 is fabricated. The body has a hexagonal cross configuration for better gripping by a user. Generally, the body supports means for forming eyelet 22 at one end of a length of wire and for forming open latch loop 28 at an opposite end of the length of wire, and means for bending the length of wire intermediate the ends thereof with the wire bent back toward itself whereby the open latch loop is engageable with the wire inwardly of eyelet 22 to form a closable spring snap 20 as shown in FIG. 1.

More particularly, the means for forming eyelet 22 includes a pair of spaced pins 34, 36 fixed to and protruding outwardly from one end of body 32, the top end as viewed in FIGS. 2, 4 and 5. The means for forming eyelet 22 also includes a bore 38 extending through body 32 and a third pin 40 protruding outwardly from the side of body 32 adjacent to but spaced from one open end of bore 38. Pin 40 has a head portion 42.

The means for forming open latch loop 28 consists of pins 34, 36.

The means for bending the wire intermediate the ends of the length thereof, with the wire bent back toward itself, and whereby the open latch loop is engageable with the wire inwardly of eyelet 22, comprises a groove 44 cut into the side of body 32, in conjunction with a fourth pin 46 protruding outwardly from the same side of the body.

As can be seen in FIG. 4, third and fourth pins 40 and 46, respectively, on opposite sides of body 32 actually comprise the protruding ends of a single rod-like member or rivet extending completely through the body. This is done for simplicity and efficient manufacture. Pins 34 and 36 simply are staked and fixed within complementary bores in the top end of body 32.

The functional details of pins 34, 36, 40 and 46, bore 38 and groove 44 now will be described in relation to FIGS. 6–13 and in conjunction with the actual forming of a closable spring snap 20 from a length of wire.

More particularly, referring to FIG. 6, a length "L" of wire first must be severed from a supply 48 thereof. The supply may be from a continuous coil of wire. Length L then is inserted through bore 38 and the continuous supply 48 is bent sharply at a right-angle 50 so as to lay alongside body 32.

After bend 50 is made in the wire, and referring to FIG. 7, the continuous supply or running length of wire 48 then is inserted into transverse groove 44 in body 32 so that the length L of wire lays alongside the body. The length of wire then can be repeatedly bent back and forth in the direction of double-headed arrow 52 until the length of wire is completely severed from the supply thereof.

At this point it should be noted that the elongated dimension of body 32 can be conveniently made so as to determine the precise length "L" of wire needed to form a completed closable spring snap 20. In this manner, extraneous tools such as pliers or wire cutting tools are not necessary and the tool of the present invention comprises a completely self-contained device for fabricating spring snaps from a continuous supply of wire. For instance, as shown, length "L" is approximately $1\frac{1}{2}$ the length of body 32.

After the length of wire is severed from the continuous supply thereof, and referring to FIG. 8, the wire is positioned between pins 34 and 36 in order to form a closed loop 54 at one end of the length of wire with a free end portion 56 of the wire extending away from the closed loop, as the first step in forming eyelet 22. Pin 34 provides an abutment stop for free end portion 56 and pin 36 is enlarged to provide a rounded surface about which the length L of wire is bent in the direction of arrow 58 to form the closed loop.

Referring to FIG. 9, it can be seen that the length L of wire can be lifted over pin 34 (from the position shown in FIG. 8) and bent backwardly against pin 34 in the direction of arrow 60 to form a very neat closed loop 54 and insure that the length of wire is at a right angle to free end portion 56 after the closed loop is formed.

At this point, it again can be shown that by dimensioning portions of the tool, proper measurements can be obtained. In particular, the free end portion 56 of the wire can be determined and, as shown, is approximately the length of rod or rivet 46 which extends through body 32.

The next step in forming eyelet 22 is illustrated in FIG. 10 and, as seen therein, the length of wire is inserted through bore 38 until closed loop 54 abuts against the side of body 32 and free end portion 56 of the wire lies flush with the side of the body. The free end portion is captured behind head 42 of pin 40. A separate implement such as an allen wrench 62, a common nail, or any other such device, is inserted through closed loop 54 and the loop is rotated while free end portion 56 of the wire is received and positioned behind head 42 of pin 40. By rotating the loop in the direction of arrow 64, the free end portion of the wire is twisted tightly and neatly about the length of the wire to completely form eyelet 22 as shown in FIGS. 1 and 11.

Referring to FIG. 11, the opposite end of the length of wire then is inserted again between pins 34, 36 and open latch loop 28 is formed by bending the length of wire in the direction of arrow 66.

After open latch loop 28 is formed on the opposite end of the wire, and referring to FIG. 12, the open latch loop 28 is inserted transversely into groove 44 of body 32 and the length of wire is bent alongside the body in the direction of arrow 68 until a neat right angle bend 70 is formed immediately adjacent the open latch loop.

Referring to FIG. 13, the wire, with eyelet 22 and open latch loop 28 now formed at opposite ends thereof then is inverted and the open latch loop 28 is again inserted into groove 44 so that the length of wire extends upwardly alongside body 32 as shown in phantom. The length of wire then is bent downwardly in the direction of arrow 72 about pin 46 until the bent portion 24 of the wire is in alignment with open latch loop 28. Of course, once the wire is released, wire portions 24, 26 will spread slightly because of the inherent resiliency of the wire.

Thus, a completely formed closable spring snap 20 is shown in its substantial formative stage in FIG. 13 as being formed by the steps shown in FIGS. 6–13 utilizing the integral components of tool 30. Except for the use of implement 62 to rotate closed loop 54 as shown in FIG. 10, which may comprise a wide variety of known items, it can be seen that the novel tool of the present invention is completely self-contained, has no moving parts, and is readily manipulatable to form a neat, tightly wrapped closable spring snap directly from a continuous supply of wire. The tool is quite versatile and, in fact, the steps shown in FIGS. 12 and 13 could be incorporated into a single continuing-motion step by inverting the direction of bending the wire shown in FIG. 12, and then continuing on with the further bending of the wire in the direction of arrow 72 as shown in FIG. 13.

The time and expense saved by the device of the present invention is readily apparent. For instance, should it be desirable to incorporate a swivel with the closable spring snap 20, the swivel simply can be assembled within closed loop 54 after being formed as shown in FIGS. 8 and 9, and before the free end portion 56 of the wire is twisted as shown in FIG. 10 to completely form eyelet 22.

It will be understood that the invention may be embodied in other specific forms without departing from the spirit or central characteristics thereof. The present examples and embodiments, therefor, are to be considered in all respects as illustrative, and the invention is not to be limited to the details given herein.

I claim:

1. A device for forming closable spring snaps from wire, comprising:

a unitary elongated body having a longitudinal axis;

means on said body for forming an eyelet at one end of a length of wire and for forming an open latch loop at an opposite end of the length of wire; and means on said body for properly positioning and facilitating bending said length of wire intermediate the ends thereof with the wire bent back toward itself whereby said open latch loop is engageable with said one end of the wire inwardly of said eyelet to form a closable spring snap, including means on one side of said body for positioning and holding said open latch loop and means on said one side of the body protruding outwardly therefrom and longitudinally axially spaced from said means for positioning and holding said open latch loop and about which the length of wire is bent back onto itself to properly position the loop engageable with the wire inwardly of said eyelet.

2. The device of claim 1 wherein said first mentioned means includes means for forming a closed loop at said one end of the length of wire with a free end portion of the wire extending away from the closed loop.

3. The device of claim 2 wherein said closed loop forming means comprises a pair of spaced pins fixed to and protruding outwardly of said body, one pin providing an abutment stop for the wire and the other pin providing a rounded surface about which the wire is bent to form the closed loop.

4. The device of claim 2 wherein said first mentioned means further includes means for twisting said free end portion of the wire about the length of wire inwardly of said closed loop to completely form said eyelet.

5. The device of claim 4 wherein said means for twisting the free end portion of the wire includes receiving means for receiving and positioning the length of wire and abutment means for engaging the free end portion of the wire and twisting the free end portion about the length of wire in response to rotation of said closed loop relative to said abutment means.

6. The device of claim 5 wherein said receiving means comprises a bore extending through said body, and said abutment means comprises a pin protruding outwardly of the body adjacent to but spaced from one end of said bore.

7. The device of claim 6 wherein said pin is provided with a head for capturing said free end portion of the wire therebehind.

8. The device of claim 1 wherein said first mentioned means comprises a pair of spaced pins fixed to and protruding outwardly of said body, one pin providing an abutment stop for the wire and the other pin providing a rounded surface about which the wire is bent to form said open latch loop.

9. The device of claim 1 wherein said positioning and holding means further includes a pin-like member protruding outwardly of said body spaced from said means for positioning and holding said open latch loop and about which the length of wire is bent back onto itself.

10. The device of claim 9 wherein said means for positioning and holding said open latch loop comprises a groove in said body, the groove being slightly wider than the thickness of the wire.

11. The device of claim 1 wherein said first mentioned means comprises a pair of spaced pins fixed to and protruding outwardly of said body to form a closed loop in the wire, and a bore through the body and a third pin to twist a free end portion of the wire adjacent to the closed loop to form said eyelet; and said holding and bending means comprises a groove in said body and a fourth pin protruding outwardly of the body.

12. The device of claim 11 wherein said pair of spaced pins are disposed at one end of the body, said bore and said third pin are disposed on one side of the body, and said groove and said fourth pin are disposed on the opposite side of the body.

13. A device for forming closable spring snaps from wire, comprising:

an elongated body having a longitudinal axis;

a pair of spaced members fixed to and protruding outwardly of said body for forming a closed loop at one end of a length of wire with a free end portion of the wire extending away from the closed loop and for forming an open latch loop at an opposite end of the length of wire, one member providing an abutment stop for the wire and the other member providing a rounded surface about which the wire is bent to form the closed loop and the open latch loop;

means on said body for twisting said free end portion of the wire about the length of wire inwardly of said closed loop to completely form an eyelet at said one end of the length of wire; and means on said body for properly positioning and facilitating bending said length of wire intermediate the ends thereof with the wire bent back toward itself whereby said open latch loop is engageable with said one end of the wire inwardly of said eyelet to form a closable spring snap, including means on one side of said body for positioning and holding said open latch loop and means on said one side of the body protruding outwardly therefrom and longitudinally axially spaced from said means for positioning and holding said open latch loop and about which the length of wire is bent back onto itself to properly position the loop engageable with the wire inwardly of said eyelet.

14. The device of claim 13 wherein said means for twisting the free end portion of the wire includes receiving means for receiving and positioning the length of wire and abutment means for engaging the free end portion of the wire and twisting the free end portion about the length of wire in response to rotation of said closed loop relative to said abutment means.

15. The device of claim 14 wherein said receiving means comprises a bore extending through said body, and said abutment means comprises a pin protruding outwardly of the body adjacent to but spaced from one end of said bore.

16. The device of claim 13 wherein said positioning and holding means further includes a pin-like member protruding outwardly of said body spaced from said means for positioning and holding said open latch loop and about which the length of wire is bent back onto itself.

17. The device of claim 13 wherein said means for positioning and holding said open latch loop comprises a groove in said body, the groove being slightly wider than the thickness of the wire.

18. A device for forming closable spring snaps from wire, comprising:

an elongated body having a longitudinal axis;

a pair of spaced pin-like members fixed to and protruding outwardly of said body for forming a closed loop at one end of a length of wire with a free end portion of the wire extending away from the closed loop and for forming an open latch loop at an opposite end of the length of wire, one pin-like member providing an abutment stop for the wire and the other pin-like member providing a rounded surface about which the wire is bent to form the closed loop and the open latch loop;

means for receiving and positioning the length of wire after said closed loop is formed, and a third pin-like member fixed to and protruding outwardly of said body for engaging said free end portion of the wire while so received and positioned and twisting the free end portion about the length of wire inwardly of said closed loop in response to rotation of the closed loop to completely form an eyelet at said one end of the length of wire; and means on one side of said body for holding said open latch loop after so formed, and a fourth pin-like member fixed to and protruding outwardly of said body on said one side thereof and longitudinally axially spaced from said means for holding said open latch loop for bending said length of wire thereabout while the open latch loop is so held until the wire is bent back toward itself so that said open latch loop is engageable with said one end of the wire inwardly of said eyelet to form a closable spring snap.

19. The device of claim 18 wherein said means for receiving and positioning the length of wire after said closed loop is formed comprises a bore extending through said body.

20. The device of claim 19 wherein said third pin-like member is provided with a head for capturing said free end portion of the wire therebehind.

21. The device of claim 19 wherein said means for holding said open latch loop comprises a groove in said body, the groove being slightly wider than the thickness of the wire.

22. The device of claim 21 wherein said pair of spaced pin-like members are disposed at one end of the body, said bore and said third pin-like member are disposed on one side of the body, and said groove and said fourth pin-like member are disposed on the opposite side of the body.

* * * * *